US005175902A

United States Patent [19]

Samuelsson

[11] Patent Number: 5,175,902

[45] Date of Patent: Jan. 5, 1993

[54] WINDOW SQUEEGEE APPARATUS

[76] Inventor: Soren Samuelsson, P.O. Box 1312, Palm Desert, Calif. 92660

[21] Appl. No.: 804,683

[22] Filed: Dec. 11, 1991

[51] Int. Cl.[5] ..... A47L 1/06

[52] U.S. Cl. ..... 15/245; 15/172

[58] Field of Search ..... 15/117, 121, 144 R, 15/172, 210 R, 219, 220 R, 235.8, 236.01, 244.2, 245; 16/110 R; 81/177.8, 177.7; 7/168

[56] References Cited

U.S. PATENT DOCUMENTS

| | | | |
|---|---|---|---|
| 303,517 | 8/1884 | Hubbard . | |
| 724,590 | 4/1903 | Lawlor . | |
| 731,338 | 6/1903 | Cattelle | 15/245 |
| 742,590 | 10/1903 | Cattelle | 15/245 |
| 1,289,638 | 12/1918 | Bruckner et al. | 15/220 R |
| 1,579,941 | 4/1926 | Jenkins . | |
| 2,225,432 | 12/1940 | Ginsberg . | |
| 2,681,464 | 6/1954 | Baril | 15/144 R |
| 2,728,099 | 12/1955 | Cocco . | |
| 2,771,623 | 11/1956 | Baril . | |
| 2,842,789 | 7/1958 | Wells . | |
| 3,079,624 | 3/1963 | Neal . | |
| 3,766,591 | 10/1973 | Soito . | |
| 4,236,270 | 12/1980 | Mavis . | |
| 4,312,093 | 1/1982 | Raab | 15/220 R X |
| 4,611,363 | 9/1986 | Samuelsson | 15/245 |
| 4,716,616 | 1/1988 | Poon | 15/144 R X |
| 4,742,595 | 5/1988 | Isaacs | 15/144 R X |
| 4,893,370 | 1/1990 | Klotz | 15/245 X |
| 5,123,137 | 6/1992 | McCauley | 15/245 X |

*Primary Examiner*—Harvey C. Hornsby
*Assistant Examiner*—C. Cooley
*Attorney, Agent, or Firm*—Fulwider, Patton, Lee & Utecht

[57] ABSTRACT

A squeegee device including a mount carried pivotally from a handle for mounting a squeegee blade in a normal position for sweeping the majority of the distance across a window pane recessed in a window opening defined by abutment walls of, for instance, a high rise building. The mount is biased to the normal position by a bias spring and a kicker arm is carried on such mount. The kicker arm is constructed to, when the apparatus approaches completion of the stroke, engage the abutment wall forming the window opening to orbit the mount and consequently such blade through an arc relative to the handle thereby accelerating movement of such wiper blade to complete the wiping stroke.

7 Claims, 1 Drawing Sheet

WINDOW SQUEEGEE APPARATUS

BACKGROUND OF THE INVENTION

1. Field of the Invention

The present invention relates generally to squeegee devices and more particularly to a squeegee device with a blade head that is manipulated to clean glass surfaces located deep in recessed corners.

2. Description of the Prior Art

Modern day architectural preferences often dictate building constructions formed with window openings into which window frames carrying panes of glass are recessed. Typical of such designs are glass panes recessed some six to eight inches inwardly from the extended plane of the exterior vertical surface of the peripheral building wall.

For aesthetic purposes, such windows must be periodically cleaned. The cleaning procedure, particularly for high rise office buildings, typically involves suspending a scaffold from the roof of the building and raising it to various elevations corresponding with the elevations of the various rows of windows so that workmen might apply water or cleaning agent to such windows and then wipe the windows clean. It has long been common practice to first wet the windows with water and then perform the drying and cleaning process by wiping a pliable squeegee blade across the window surface maintaining a constant pressure thereon to affect a uniform sweep removing the residual water from the window surface. Workmen cleaning the windows of high rise buildings are often working under a contract which provides economic rewards for enhanced efficiency in the cleaning process. It is appreciated in the window cleaning field that horizontal strokes for the squeegee are typically more efficient, requiring less energy on behalf of the workmen, than would be the case for vertical strokes along an elongated window on the order of five or six feet in height.

Squeegee devices utilized in the cleaning process typically incorporate fittings formed with a barrel for receipt of the end of a wooden handle and carrying rigidly therefrom a cross bar mount which mounts the squeegee blade disposed at a predetermined and fixed angle relative to the handle. The squeegee blade is typically oriented at about 60° to the axis of the handle. The workman manipulating such a squeegee through a horizontal path from the right to left hand side of a recessed window pane would then insert the blade at the right hand edge of the window and wipe it across the window surface holding the handle at an angle of about 25° to 30° relative to the window surface. With this configuration, as the left hand edge of the window pane is approached, the handle, when maintained at such an orientation relative to the window, would strike the abutment wall defining the recess at the left hand side of the window to avoid such contact and provide for full completion of the squeegee blade stroke to the left hand edge of the glass.

It has also been a long recognized shortcoming of existing squeegee devices that, with the fixed angular orientation of the squeegee blade relative to the handle, the workman's hand grasping such handle is frequently brought into contact with the rough surface of the exterior wall as the wiping stroke is nearing completion. This is frequent cause for injury, discomfort and sometimes incapacity of the workman endeavoring to manipulate the device.

Consequently, there exists a need for a squeegee device having the squeegee head articulated relative to the handle such that the wiping stroke might be completed without excessive manipulation of the handle or exposure of the workman's hands to unnecessary injury.

Articulated squeegee frames have been proposed for different purposes As an example, a squeegee device has been proposed which includes a squeegee blade carried pivotally from a handle and pivotable from one side to the other to accommodate either pushing or pulling of the squeegee device across the surface to be cleaned. A device of this type is shown in U.S. Pat. No. 3,079,624 to Neal.

Other proposals have been made for rotating squeegee heads to different orientations relative to the handle. One such device is shown in U.S. Pat. No. 4,236,270 to Mavis. Such devices, while satisfactory for their intended purposes, fail to provide an arrangement for automatically reorienting the squeegee blade relative to the handle upon approach of the distal window frame wall upon completion of the stroke.

Other efforts have led to the proposal of squeegee heads which might be adjusted from one pivotable location to another for convenient use in locations which are awkward to excess. A device of this type is shown in U.S. Pat. No. 1,579,941 to Jenkins.

SUMMARY OF THE INVENTION

The squeegee device of the present invention is characterized by a kicker arm which engages the wall defining the window opening as the end of the squeegee stroke is approached to thereby reorient the squeegee blade relative to the handle to facilitate completion of the stroke.

Other objects and features of the invention will become apparent from consideration of the following description taken in conjunction with the accompany drawing.

DETAILED DESCRIPTION OF THE PREFERRED EMBODIMENT

Figure 1:
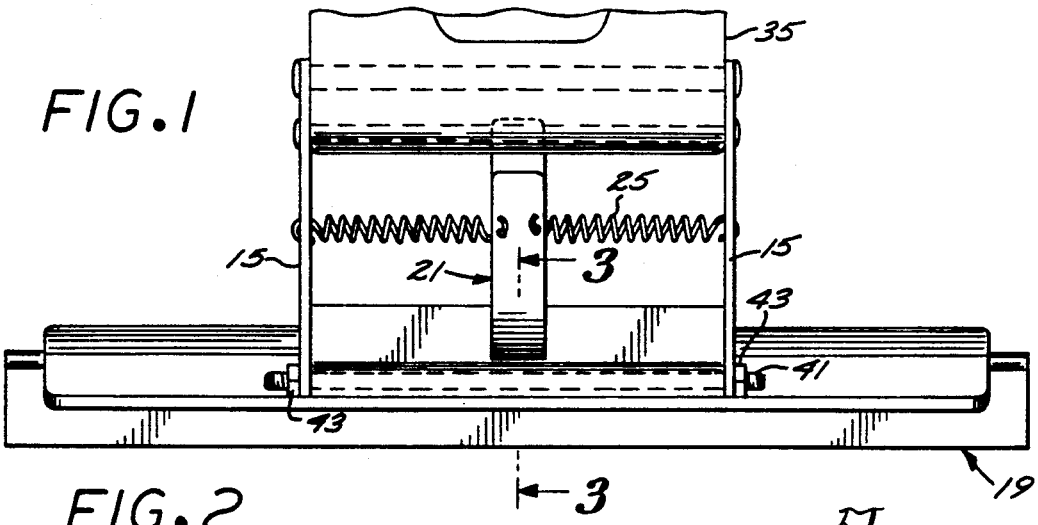
FIG. 1 is a partial top view of a squeegee apparatus incorporated in the present invention.

The squeegee apparatus of the present invention includes, generally, an elongated handle 11 received in the barrel of fitting 13 including on the distal end thereof a pair of laterally spaced apart mounting fingers 15. Mounted between the distal end of such fingers 15 is a cross bore defining a squeegee blade mount, generally designated 17, which mounts an elongated squeegee blade, generally designated 19. Mounted on the back side of the mount 17 is a U-shaped kicker, generally designated 21. The kicker 21 is biased to the orientation shown in FIG. 4 by means of a pair of tension springs 25. Thus, the squeegee blade 19 may be drawn to the right hand side of the window pane 27 causing the kicker 21 to engage the abutment wall 29 causing such mount 17 to pivot counterclockwise to the position shown in FIG. 5 to thereby draw the squeegee blade 19 to the right relative to the fitting 13 thereby completing the stroke across the surface of such window pane 27.

Typically, squeegees are constructed with a rigid connection between the handle and squeegee blade thus disposing the blade at a fixed angle relative to the handle itself. With modern day high rise buildings, such as office towers, the window panes 27 are recessed inwardly from the exterior surface 31 of a building, thus creating abutment walls 33 and 29 at the opposite ends of the window cavity. Oftentimes the window pane 27 may be recessed some five to eight inches from the surface 31 thus creating abutment walls 29 and 33 which are relatively deep, thereby exhibiting a challenge to the window washer who is often working under contract or by piece work thus presenting an incentive to rapidly perform the washing task. Oftentimes the handle 11 is relatively long and the worker must work from a platform elevated high over the city sidewalks. Thus, manipulation of the squeegee to affect a full stroke from one to the other of the window pane 27 exhibits a challenge both from the standpoint of orientation of the worker's body during the entire stroke and from the fact that failure to reorient the handle 11 during such stroke can result in bruising contact of the hands of the workers grasping such handle with the relatively rough surface at the abutment wall 29 or with the corner formed between such wall and the building surface thereby inflicting injury resulting in tremendous discomfort and sometimes disability to the worker.

The squeegee apparatus of the present invention overcomes this deficiency. The fitting 13 is formed of a conventional tubular barrel shape tapering forwardly and downwardly and expanding laterally outwardly to form a mounting web 35 (FIG. 1). Mounted rigidly to the opposite sides of such web 35 are the respective mounting fingers 15 which extend downwardly to mount at the respective distal ends thereof the opposite ends of a threaded pivot rod 41 having fastener nuts 43 screwed thereonto.

Figure 2:
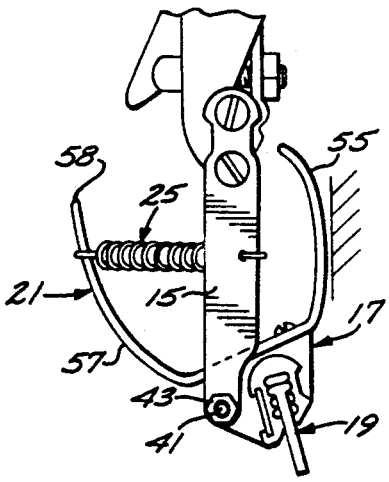
FIG. 2 is a left hand end view of the squeegee apparatus shown in FIG. 1.
Figure 3:
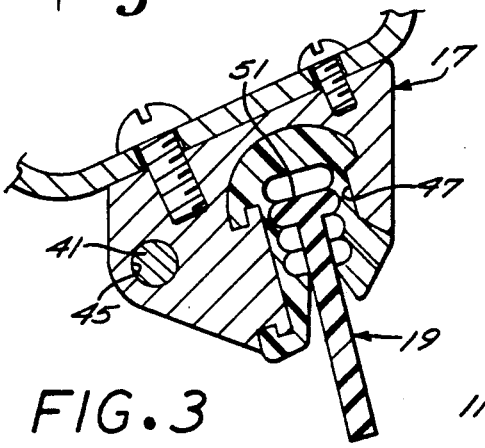
FIG. 3 is a partial vertical sectional view in enlarged scale taken along the line 3—3 of FIG. 1.

Referring to FIGS. 2 and 3, the mount 17 may be typically constructed of hard plastic and is formed on one side with a transversely extending bore 45 for receipt of the rod 41. Formed at a location spaced about one inch lateral of the axis of the pin 41 is a formed cavity 47 constructed to receive therein a formed liner 49. Received within the liner 49 is the base 51 of the squeegee blade 19. The squeegee blade 19 and liner 49 may be of the construction shown and described in my U.S. Pat. No. 4,611,363. Preferably such blade projects laterally beyond the opposite ends of the mount 17 to form flexible overhangs.

Mounted centrally on the back side of the mount 17 is the kicker 21. The kicker 21 is of a generally horseshoe shape to form oppositely disposed outwardly diverging kicker arms 55 and 57 which then curves inwardly toward one another (FIG. 2).

The kicker arm 55 projects outwardly and rearwardly from the holder 17 and then curves inwardly to form on its outer surface no outwardly facing curved abutment surface configured to abut the wall 29 and, as travel to the right is continued, slide outwardly thereon away from the window pane to turn such holder counterclockwise about the rod 41.

The other kicker arm 57 also curves inwardly and terminates in an end 58 which, upon rotation clockwise, abuts the fitting 13 at the stop location 60 (FIG. 4) to block further travel thereof. Referring to FIG. 1, the tension springs 25 are connected between the arm 57 and opposed mounting fingers 15 to normally draw the arm 57 inwardly as shown in FIG. 2 thus normally maintaining the mount 17 rotated to such clockwise orientation shown in FIG. 4.

In operation, it is convenient for the workman to utilize the squeegee apparatus of the present invention by drawing the squeegee blade 19 across the window pane 27 in a generally horizontal direction. It has been discovered that for many applications, such a stroke is much more energy efficient and desirable to avoid worker fatigue.

Figure 4:
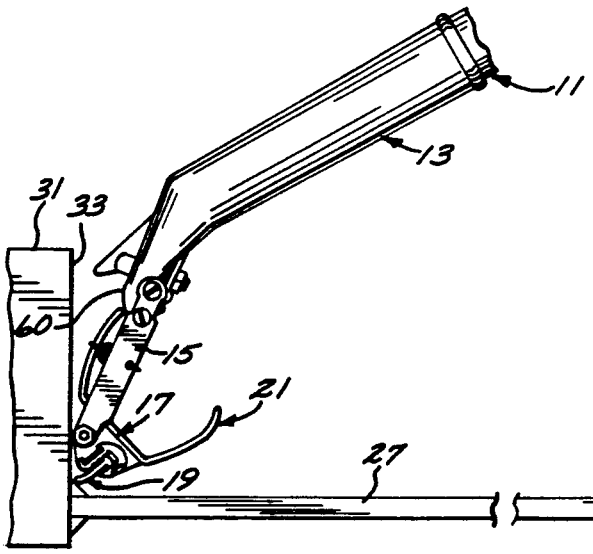
FIG. 4 is a left hand end view of the squeegee apparatus shown in FIG. 1 in reduced scale and depicting it in a wiping operation.
Figure 5:
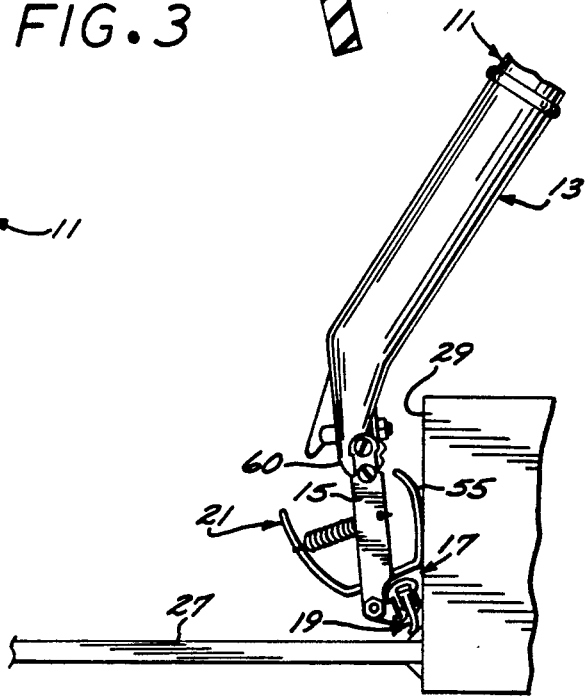
FIG. 5 is a left hand end view similar to FIG. 4.

It will be appreciated to those skilled in the art that the workman will grasp the handle 11 and insert the blade 19 into what one facing the pane 27 would consider the right hand corner formed between the abutment wall 33 and window pane 27 as shown in FIG. 4 to initiate the wiping stroke. In this configuration, the terminal end 58 of the arm 57 is in contact with the stop 60 as shown in FIG. 4 to thus limit clockwise rotation of the mount 19 relative to the fitting 13. In this orientation, the workman may apply a wiping force to the handle 11 thus slightly deflecting the blade 19 to cause it to closely follow the surface of the window pane 27 to thereby affect a clean wipe leaving the window surface unstreaked and clear of unwanted traces.

As the workman then draws the squeegee to the right across the surface of the pane 27 approaching the right hand abutment wall 29, the right hand kicker arm 55 will engage such abutment wall 29. As rightward movement of the squeegee assembly is continued, the shape of the kicker arm 55 will cause the free end of the kicker arm 55 to be driven inwardly toward the fingers 15 thus causing the mount 17 to rotate counterclockwise around the pivot pin 41 thereby orbiting the squeegee blade 19 about such pivot pin and sweeping it through an arc relative thereto. The consequent mechanical advantage augments travel of the working edge of the blade 19 relative to the fitting 13. This then causes the wiper blade 19 to complete the wiping stroke fully into the corner between the plane of the window 27 and the abutment wall 29 to wipe the surface thereof clean and enable the residue to be lifted therefrom to be wiped away without requiring excessive manipulation of the handle 11. This then eliminates the danger of hand injury associated with many prior art squeegee assemblies due to the necessity that, at one end of the stroke, it was necessary for the workman to manipulate it into a position which oftentimes engaged his or her knuckles with the rough exterior of the building wall. This is achieved without sacrificing a complete stroke across the surface of the window, a sacrifice which might otherwise result in incomplete window cleaning.

From the foregoing, it will be appreciated that the squeegee apparatus of the present invention provides a reliable and sturdy device for conveniently affecting cleaning of a window pane recessed behind the plane of the exterior building wall minimizing injury and fatigue of the workman.

Various modifications and changes may be made with regard to the foregoing detailed description without departing from the spirit of the invention.

I claim :

1. Stroke augmenting window squeegee apparatus for wiping a recessed window pane as it is drawn in a selected direction across the surface of said pane from a first recessed abutment wall to a second recessed abutment wall, said apparatus comprising:

an elongated handle fitting projecting forwardly and rearwardly to define a longitudinal axis and including a rearwardly projecting handle and a pair of forwardly projecting, laterally spaced apart mounting fingers;

a squeegee blade holder mounted on said fingers projecting perpendicular to said axis and rotatable relative to said fitting from a normal holder position to an advanced holder position;

a planar squeegee blade carried from said holder and projecting forwardly therefrom to terminate in a working edge projecting laterally of said axis;

a pivot rod mounting said holder from said fingers for rotation of said holder thereabout to carry said blade from a normal blade position wherein said blade extends generally coextensive with said axis to an advanced blade position wherein said working edge is drawn rearwardly relative to said handle fitting;

a kicker carried from said holder and including a kicker arm configured to, when said holder is in said normal holder position, project rearwardly from said holder and form an abutment surface facing outwardly from said axis and rearwardly of said blade;

at least one spring coupled between one of said fingers and said kicker arm for biasing said holder to said normal holder position such that when said handle is drawn in said selected direction to draw said blade across said surface of said pane, said abutment surface of said kicker arm will be carried into contact with said second abutment wall so that, upon further travel of said handle fitting in said selected direction, said abutment wall will prevent further travel of said kicker arm in said one direction and thereby cause said kicker arm to rotate said holder relative to said handle fitting to cause said holder to rotate about said pivot rod and rotate said blade from said normal blade position to said advanced blade position.

2. A window squeegee apparatus as set forth in claim 1 wherein:

said blade holder is constructed to project laterally to one side of said fingers to space said squeegee blade laterally to one side of said pivot rod.

3. A window squeegee apparatus as set forth in claim 1 wherein:

said blade is generally planar; and said kicker arm is in the form of a feeler arm projecting generally outwardly and away from a plane including said blade.

4. A window squeegee apparatus as set forth in claim 1 wherein:

said kicker is generally U-shaped to form a pair of outwardly diverging arms projecting away from said blade; and said spring connects between one of said arms and at least one of said fingers.

5. Stroke augmenting window squeegee apparatus according to claim 5 wherein:

said kicker is disposed equidistant between said fingers.

6. A window squeegee apparatus as set forth in claim 1 wherein:

said holder is in the form of an elongated channel; and said blade is received in said channel and projects from the opposite ends thereof to form flexible overhang segments.

7. Stroke augmenting window squeegee apparatus according to claim 1 wherein:

said kicker is disposed equidistant between said fingers.

* * * * *